US006221551B1

(12) United States Patent
Bonsignore et al.

(10) Patent No.: US 6,221,551 B1
(45) Date of Patent: Apr. 24, 2001

(54) METHOD OF PRODUCING LIQUID TONER WITH POLYESTER RESIN

(75) Inventors: Frank J. Bonsignore; Christopher P. Manos, both of Rochester; George A. Gibson, Fairport, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/404,629

(22) Filed: Sep. 23, 1999

(51) Int. Cl.[7] ..... G03G 9/00
(52) U.S. Cl. ..... 430/114; 430/137
(58) Field of Search ..... 430/114, 137

(56) References Cited

U.S. PATENT DOCUMENTS

| | | |
|---|---|---|
| 3,590,000 | 6/1971 | Palermiti et al. . |
| 4,265,990 | 5/1981 | Stolka et al. . |
| 4,760,009 | 7/1988 | Larson . |
| 5,223,368 | 6/1993 | Ciccarelli et al. . |
| 5,254,427 | 10/1993 | Lane et al. . |
| 5,376,494 | 12/1994 | Mahabadi et al. . |
| 5,414,498 | 5/1995 | Buchan et al. . |
| 5,563,015 | 10/1996 | Bonsignore et al. . |
| 5,604,075 | 2/1997 | Larson et al. . |
| 5,672,456 | 9/1997 | Chamberlain et al. . |
| 5,688,624 | 11/1997 | Chamberlain et al. . |
| 5,783,349 | 7/1998 | Spiewak et al. . |
| 5,866,292 | 2/1999 | Chamberlain et al. . |

*Primary Examiner*—Mark Chapman
(74) *Attorney, Agent, or Firm*—Oliff & Berridge, PLC

(57) ABSTRACT

A method for producing a liquid toner composition includes: melt-mixing a colorant and a thermoplastic resin in an extruder to homogeneously disperse the colorant in the thermoplastic resin to form a colorant/resin mixture; mixing the colorant/resin mixture with a non-polar liquid to form a dispersion; and cold grinding the dispersion to form toner particles of the colorant/resin mixture dispersed in the non-polar liquid, wherein the particles have an average particle size of less than about 20 $\mu$m.

20 Claims, No Drawings

METHOD OF PRODUCING LIQUID TONER WITH POLYESTER RESIN

BACKGROUND OF THE INVENTION

1. Field of Invention

This invention relates to a method for producing a liquid toner or developer composition, more particularly a liquid toner or developer composition comprising polyester resin particles. The invention also relates to liquid toner or developer compositions made by such a process, and the use of such liquid toner or developer compositions in electrostatographic imaging processes.

2. Description of Related Art

A latent electrostatic image can be developed with toner particles dispersed in an insulating non-polar liquid. Such dispersed materials are known as liquid toners or liquid developers. A latent electrostatic image may be produced by providing a photoconductive layer with a uniform electrostatic charge and subsequently discharging the electrostatic charge by exposing it to a beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a non-polar liquid. The image may then be transferred to a substrate or receiver sheet, such as paper or transparency.

Insufficient particle charge can result in poor image quality and also can result in poor transfer of the liquid developer or solids thereof to paper or other final substrates. Poor transfer can, for example, result in poor solid area coverage if, for example, insufficient toner is transferred to the final substrate, and can also cause image defects such as smears and hollowed fine features. Conversely, overcharging the toner particles can result in low reflective optical density images or poor color richness or chroma since only a few very highly charged particles can discharge all the charge on the dielectric receptor, causing too little toner to be deposited.

Useful liquid toners comprise thermoplastic resin toner particles and a dispersant non-polar liquid. Generally, a suitable colorant, such as a dye or pigment, is present in the toner particles. The colored toner particles are dispersed in a non-polar liquid which generally has a high volume resistivity in excess of $10^9$ Ω-cm, a low dielectric constant, for example below 3.0, and a high vapor pressure. Generally, the toner particles have an average particle size (by area) or diameter of less than 7 microns as measured with a Horiba CAPA 700 Particle Sizer.

Various methods are known in the art for producing liquid toners and developers. The conventional process for producing such liquid toners involves a two-step batch process, wherein the first step involves a hot step where the non-polar liquid and molten resin are melt mixed with pigment and other additives, and the second step involves a cold step where the molten contents are cooled to cause solidification and formation of particles in the non-polar liquid.

For example, one process of making such liquid toners is described in U.S. Pat. No. 4,760,009, which describes such a two step process. According to the patent, the process comprises a first step of dispersing a thermoplastic resin, a non-polar liquid having a Kauri-butanol value of less than 30, and optionally a colorant at an elevated temperature in a vessel by means of moving particulate media. The temperature in the vessel is maintained at a temperature sufficient to plasticize and liquefy the resin and below that at which the non-polar liquid boils and the resin and/or colorant decomposes. In a second step, the dispersion is cooled to permit precipitation of the resin out of the dispersant. The particulate media is maintained in continuous movement during and subsequent to the cooling. Both steps are carried out in a suitable vessel, such as an attritor, a heated ball mill, or a heated vibratory mill, equipped with particulate media for dispersing and grinding. The result is described as toner particles having an average by area particle size of less than 10 μm and a plurality of fibers. Following the second step, the dispersion of toner particles can be separated from the particulate media.

The patent describes that useful thermoplastic resins or polymers that are able to form fibers and that can be used in the production method include ethylene vinyl acetate copolymers, copolymers of ethylene and an α, β-ethylenically unsaturated acid, copolymers of ethylene/acrylic or methacrylic acid/alkyl (C1 to C5) ester of methacrylic or acrylic acid, polyethylene, isotactic polypropylene (crystalline), ethylene ethyl acrylate series, and ethylene vinyl acetate resins. The patent does not describe use of the disclosed method to produce polyester-based liquid toners or developers.

In fact, the conventional two-step process such as disclosed in U.S. Pat. No. 4,760,009 cannot be used to form acceptable liquid toners or developers from polyester resins. In particular, polyester resins tend not to form a continuous phase with the non-polar liquids such as are used in the hot step. Furthermore, polyesters cannot generally be used in the conventional two-step process because the viscosity of polyester resins at the high temperatures used in the process are too high for adequate dispersion of the colorant and other additives in the resin.

Other methods for forming liquid toners, which are generally variants of the above process, are described, for example, in U.S. Pat. Nos. 5,604,075, 5,688,624, 5,783,349 and 5,866,292. For example, U.S. Pat. No. 5,604,075 describes a process for the preparation of liquid developers with reduced fines, which comprises heating a liquid developer comprised of thermoplastic resin, pigment, charge adjuvant, liquid hydrocarbon, and optional charge director. The heating is accomplished at about 5° C. below the melting point of the thermoplastic resin, which heating enables the fines comprised of the developer components, and of a size diameter of from about 0.1 to about 0.4 micron to be reduced. Although this patent describes that polyester can be used as a suitable thermoplastic toner resin for the liquid developer, improved dispersion of the various toner components is desired to provide improved image development results.

Thus, a need continues to exist in the art for improved liquid toners and developers that provide high print quality, and for methods for producing such liquid toners and developers. This need is particularly evident for producing liquid toners and developers that are based on polyester as the thermoplastic resin.

SUMMARY OF THE INVENTION

Accordingly, the present invention provides a new method for producing liquid toner and developer compositions, which can advantageously be applied to the production of such liquid toner and developer compositions, and particularly those using polyester resin materials. The processes of the present invention overcome the above-described problems of the prior art, and allow the production of polyester-based liquid toner and developer compositions wherein the colorant and other additives are homogeneously or uniformly dispersed in the polyester resin.

In embodiments, the present invention is directed to a method for producing a liquid toner composition comprising:

melt-mixing a colorant and a thermoplastic resin in an extruder to homogeneously disperse the colorant in the thermoplastic resin to form a colorant/resin mixture;

mixing the colorant/resin mixture with a non-polar liquid to form a dispersion; and cold grinding the dispersion to form toner particles of the colorant/resin mixture dispersed in said non-polar liquid, wherein the particles have an average particle size of less than about 20 $\mu$m.

DETAILED DESCRIPTION OF PREFERRED EMBODIMENTS

According to the present invention, a liquid toner or developer composition can be prepared by a process including the steps of (1) preparing a colorant/resin mixture, and (2) cold grinding the colorant/resin mixture with addition of a suitable non-polar liquid, to prepare the final liquid toner or developer composition. In embodiments of the present invention, the liquid toner can be dry ground between the above steps (1) and (2) to reduce the particle size of the colorant/resin mixture prior to the cold grinding step.

As discussed above, conventional processing does not allow production of a homogeneous or uniform mixture of a colorant in the resin material when polyester is used as the resin. However, this problem is overcome in the present invention by using an extruder or similar processing equipment to conduct the initial mixing operation.

In the first step of the liquid toner formation process, a thorough melt-mix and dispersion of pigment and/or other additives in the resin material is formed. Preferably, although not necessary, the pigment is in the form of a flushed pigment, described below. This melt-mixing is performed using an extruder or similar processing equipment, which provides a homogeneous or uniform dispersion of the colorant and/or other additives in the resin, despite the higher viscosities that can be created by polyester and other resins. In producing the homogeneous dispersion, the desired resin material is melt-mixed with any desired colorant and/or other additives that are to be incorporated into the liquid toner. Because other processing equipment, such as an attritor, cannot provide the necessary homogeneous dispersion of the colorant and/or other additives in the resin, such equipment is not used in the first step.

The first (melt-mixing) step can be conducted in any suitable processing equipment that will provide the necessary homogeneous dispersion of the colorant and/or other additives in the resin. Thus, although an extruder is preferred, other suitable equipment can include a Banbury mill, a 2 roll mill, or a sigma blade mixer. Suitable operating parameters for such mixing equipment can readily be determined by one of ordinary skill in the art based on the various components to be melt-mixed. In the case of an extruder, suitable mixing is obtained, for example, at a mixing temperature of from about 104 to 122° C. (220 to 251° F.), melt (just before the material exits the die) and die temperatures of about 115–117° C. (240–243° F.), and screw rpm of about 15 rpm with an extrusion pressure of from about 270 to 490 psi. Of course, these are exemplary parameters only, and are not limiting on the present invention.

Suitable additives that can be melt-mixed with the resin material and incorporated into the liquid toner include, but are not limited to, colorants, adjuvants and charge control additives. Other suitable additives, known to those of ordinary skill in the art, can also be incorporated into the liquid toner in known amounts for their known purposes.

Suitable colorants for use in embodiments of the present invention can include any of the various colorants, such as pigments or dyes and mixtures thereof. Such colorants are preferably present in the liquid toner to render the resultant developed latent image visible. The colorant, preferably a pigment, may be present in the liquid toner in an effective amount of, for example, from about 0.1 to about 60 percent, and preferably from about 10 to about 50 percent, and in embodiments more preferably from about 20 to 40 percent by weight, based on the total weight of solids contained in the liquid toner. Even more preferably, the colorant concentration is from about 20 to about 30 percent by weight, based on the total weight of solids contained in the liquid toner. The amount of colorant used may vary depending on the use of the liquid toner.

Examples of suitable pigments that may be used according to the present invention include, but are not limited to, carbon blacks available from, for example, Cabot Corporation, such as MONARCH 1300®, REGAL 330® and BLACK PEARLS®, and pigments such as FANAL PINK™, PV FAST BLUE™, SUNFAST BLUE 15:3, pigments as illustrated in U.S. Pat. Nos. 5,223,368 and 5,254,427, the entire disclosures of which are incorporated herein by reference, other known pigments, mixtures thereof, and the like. For example, suitable pigments that may be used in the present toners and developers include those set forth below:

| Pigment Brand Name | Manufacturer | Color |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chem. | Yellow 14 |
| L75-1331 Yellow | Sun Chem. | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| L75-2337 Yellow | Sun Chem. | Yellow 83 |
| Cromophthal ® Yellow 3G | Ciba Geigy | Yellow 93 |
| Cromophthal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophthal ® Yellow 8G | Ciba-Geigy | Yellow 128 |
| Irgazine ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoecht | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue TBD 7010 | BASF | Blue:3 |
| Heliogen ® Blue K 7090 | BASF | Blue 15:3 |
| Heliogen ® Blue L 7101F | BASF | Blue 15:4 |
| Heliogen ® Blue L 6470 | BASF | Blue 60 |

-continued

| Pigment Brand Name | Manufacturer | Color |
|---|---|---|
| Heliogen ® Green K 8683 | BASF | Green 7 |
| Heliogen ® Green L 9140 | BASF | Green 36 |
| Monastral ® Violet | Ciba-Geigy | Violet 19 |
| Monastral ® Red | Ciba-Geigy | Violet 19 |
| Quindo ® Red 6700 | Mobay | Violet 19 |
| Quindo ® Red 6713 | Mobay | Violet 19 |
| Indofast ® Violet | Mobay | Violet 19 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L | Cabot | Black, CI 77266 |
| Uhlich ® BK 8200 | Paul Uhlich | Black |

According to the present invention, because liquid toners typically have a final colorant content of 20 percent by weight or more, it is particularly advantageous to supply the colorant, particularly pigment, in the form of a flushed colorant. That is, it is preferred that the colorant be provided in the form of the pigment predispersed in an amount of the desired resin material, so that the content of the pigment in the flushed colorant is from about 40 to about 50 percent by weight. As is known in the art, a flushed pigment is generally produced by combining, in a powerful mixing apparatus, an amount of the desired resin dissolved in a solvent, and an aqueous dispersion of the pigment with a pigment concentration of about 40 to 50 percent by weight. This aqueous dispersion of the pigment at such a high concentration is generally referred to as a "presscake." A suitable mixer for forming the flushed pigment includes, for example, a sigma blade mixer. When the components are mixed in the mixer, water from the presscake is displaced by the solvent, and is poured or drawn off. The result is the pigment thoroughly dispersed in the dissolved resin. Finally, the solvent is removed, to provide a flushed pigment, comprising a resin with a pigment concentration or loading of about 40 to 50 percent by weight.

Suitable flushed pigments, which can be used in toners and developers of the present invention include, but are not limited to, those available from BASF and/or flushed into suitable resins. Examples of such flushed pigments include, but are not limited to, BASF Blue Lupreton SE 1163, which consists of Pigment Blue 15:3 at 40% loading dispersed in ". . . a linear copolymer of fumaric acid and bisphenol A"; Yellow SE 1161 (BASF); Pink SE 1162 (BASF); Red SE 1255 (BASF); and Pigment Blue 15:3 flushed into Spar II resin, available from Sun Chemical.

Of course, the colorant need not necessarily be provided in the form of a flushed colorant. Rather, any suitable colorant material may be used, so long as the colorant concentration in the final liquid toner can be provided to obtain desired print quality, and so long as the colorant material is not incompatible with the extruder mixing operation.

Various dyes, including organic dyes, can also be used as the colorant material to color the resin particles. That is, the resin may be treated with any suitable organic dye to impart color to it. When used, the organic dye is preferably dispersible at the molecular level in the resin to provide a molecular dispersion and ensure good distribution, since it would otherwise tend to aggregate and give poor color intensity as well as broadened spectral characteristics. Furthermore, the organic dye should be insoluble in the carrier liquid so that once it is imbibed into the resin, it will not diffuse out into the dispersion medium. In addition, insolubility in the dispersion medium ensures that the background deposits will be minimized, since as noted above, the entire imaging surface may be contacted with the liquid developer during development of the electrostatic latent image and the dye cannot deposit on the background areas of the imaging surface if the dye is insoluble in the liquid phase. Moreover, it is preferred that the dye be water insoluble to ensure permanence of the developed image and to avoid dissolving subsequent to development should the image come into contact with water as may frequently be the case in an office environment with coffee, tea and the like. Typical organic dyes include Orasol Blue GN, Orasol Red 2BL, Orasol Blue BLN, Orasol Black GN, Orasol Black RL, Orasol Yellow 2RLN, Orasol Red 2B, Orasol Blue 2GLN, Orasol Yellow 2GLN, Orasol Red G, available from Ciba Geigy, Mississauga, Ontario, Canada; Morfast Blue 100, Morfast Red 101, Morfast Red 104, Morfast Yellow 102, Morfast Black 101, available from Morton Chemical Limited, Ajax, Ontario, Canada; and Savinyl Yellow RLS, Savinyl Yellow 2RLS, Savinyl Pink 6BLS, Savinyl Red 3BLS, Savinyl Red GL5, Savinyl Black RLS available from Sandoz, Mississauga, Ontario, Canada and Neozapon Black X57 from BASF, Toronto, Ontario, and the like.

Furthermore, other ingredients, known as adjuvants, may be added to the colorant/resin mixture. For example, fine particle size oxides, e.g., silica, alumina, titania, etc., preferably in a particle size on the order of 0.8 $\mu$m or less, can be dispersed into the liquefied resin in the toner. These oxides can be used alone or in combination with the colorant. Metal particles can also be added.

Another optional additional component of the electrostatic liquid developer is an adjuvant, which can include, but is not limited to, polyhydroxy compounds, aminoalcohol, polybutylene succinimides, metallic soaps, aromatic hydrocarbons having a kauri-butanol value of greater than 30, mixtures thereof, and the like. These adjuvants are generally used in an amount of 1 to 1000 mg/g, preferably 1 to 200 mg/g of developer solids. Examples of the various above-described adjuvants include, but are not limited to:

A) polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glyceroltri-12 hydroxystearate, ethylene glycol monohydroxystearate, propylene glycerol monohydroxy-stearate;

B) aminoalcohol compounds: triisopropanolamine, triethanolamine, ethanolamine, 3-amino-i-propanol, o-aminophenol, 5-amino-1-pentanol, tetra(2-hydroxyethyl)ethylenediamine;

C) polybutylene/succinimide: OLOA™-1200 sold by Chevron Corp.; Amoco 575 having a number average molecular weight of about 600 (vapor pressure osmometry) made by reacting maleic anhydride which in turn is reacted with a polyamine (Amoco 575 is 40 to 45% surfactant, 364 aromatic hydrocarbon, and the remainder oil);

D) metallic soaps: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium, cobalt, manganese, lead and zinc naphthenates; calcium, cobalt, manganese, lead and zinc resinates;

E) aromatic hydrocarbons: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of C9 and C10 alkyl-substituted benzenes manufactured by Exxon Corp.

Various other additives, which are known in the art, can also be incorporated into the developers of the present invention. Such additives can be incorporated either into the resin/colorant mixtures, i.e., mixed directly into the toner or developer particles, or can be added as surface agents on the surface of the resin./colorant particles once formed.

When the above additives are to be incorporated into the liquid toner, it is preferred that they be added with the resin material and preferably in the extruder mixing step. This permits the additives to be dispersed directly and uniformly into the resin particles. In embodiments of the present invention, it is particularly preferred that at least the colorant be added with the resin material in the extruder mixing step, and it is particularly preferred that all of the additives, except for the non-polar liquid, be added with the resin material in the extruder mixing step. However, in other embodiments, some of the additives can be added at earlier or subsequent stages of the toner preparation process.

The present invention is particularly applicable to liquid toners that use polyester resins as the resin material. Thus, in embodiments of the present invention, it is preferred that the resin material is, in whole or in part, polyester resin. Suitable examples of such polyester resins include, but are not limited to, polyester, particularly the SPAR polyesters, which are commercially available, and are described in U.S. Pat. No. 3,590,000, the entire disclosure of which is incorporated herein by reference; reactive extruded polyesters, with a gel amount of from about 10 to about 40 percent by weight, or other gel amounts, or substantially no gel, as described in U.S. Pat. No. 5,376,494, the entire disclosure of which is incorporated herein by reference; mixtures thereof and the like. Mixtures of polyester with one or more other resins can also be used. Furthermore, the polyester can be present either as a polyester homopolymer, or other resin species may be present with the polyester in the form of a copolymer, terpolymer, or the like, in block form, graft form, or the like.

The present invention is also applicable to the use of other resin materials, and is not limited to use with polyester resin materials. Typical examples of other suitable thermoplastic toner resins include, but are not limited to, ethylene vinyl acetate (EVA) copolymers (such as ELVAX™ resins, available from E.I. DuPont de Nemours and Company, Wilmington, Del.); copolymers of ethylene and an α,β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series, such as available as BAKELITE™ DPD 6169, DPDA 6182 NATURAL™ ( available from Union Carbide Corporation, Stamford, Conn.); ethylene vinyl acetate resins like DQDA 6832 Natural 7 (available from Union Carbide Corporation); SURLYN™ ionomer resin (available from E.I. DuPont de Nemours and Company); or blends thereof; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE™ acrylic resins (available from E.I. DuPont de Nemours and Company); or blends thereof.

According to the present invention, the resin material is present in any effective amount to provide a suitable liquid toner. Generally, the resin material can be present in an amount of from about 99.9 percent to about 40 percent by weight, and preferably from about 80 percent to about 50 percent by weight, of total solids in the liquid toner composition. However, amounts outside of these ranges may be acceptable, in embodiments.

As described above, it is preferred in embodiments that the colorant be provided in the form of a flushed colorant. In these embodiments, the resin material used to make the flushed colorant, or otherwise present in the flushed colorant, is preferably the same as the resin material to which the flushed colorant is added in the extruder mixing step. Thus, the extruder mixing step has the effect of "letting down" the flushed colorant, by reducing the colorant concentration by addition of further resin material.

Following mixing in the extruder, the extrudate product can, if desired, be ground to provide a material having a smaller particle size prior to being processed in the cold grinding step. Where such intermediate grinding is conducted, it is preferred that the grinding be dry grinding, i.e., in the absence of any or significant quantities of solvent and/or other liquids. Such grinding can be performed, for example, in a Fitz mill or other suitable grinding apparatus. Such grinding can be conducted to reduce the particle size of the colorant/resin composition to a smaller particle size. For example, grinding to a particle size of from about 100 to about 2,000 μm, preferably 200 to about 1,500 μm, or more preferably from about 500 to about 1,000 μm, provides acceptable results.

Where an intermediate pre-grinding step is used and additives are to be added to the resin/colorant mixture between the extruder mixing step and the subsequent cold grinding step, such additives can be added at any appropriate time with respect to the pre-grinding step. That is, if desired, such additives can be added to the resin/colorant mixture after extrusion from the extruder, but prior to the pre-grinding operation. This procedure allows the additives to be mixed and ground with the resin/colorant mixture. Alternatively, the additive can be added subsequent to the pre-grinding operation but prior to the cold grinding operation. This procedure is particularly suited for situations where the additive is in either a liquid solution or dispersion form. Of course, if desired, the additive can also be fed into the resin/colorant mixture during the pre-grinding operation, if desired.

The extrudate material, optionally further ground to a smaller particle size, is next processed in a cold grinding operation in an attritor or similar processing equipment. This cold grinding stage is generally comparable to the cold grinding operation performed in the conventional liquid toner preparation process.

The extrudate material is mixed in the mixing apparatus with a sufficient quantity of a non-polar liquid to arrive at a suitable concentration for the grinding operation, or at the desired solids content loading of the liquid toner.

Examples of suitable non-polar liquid carriers that can be used to form the liquid toners or developers according to embodiments of the present invention generally include any of the various known or after-developed liquid carriers that provide desired properties to the liquid toner. For example, suitable non-polar liquids include, but are not limited to, those having an effective viscosity of, for example, from about 0.5 to about 500 centipoise at 25° C., and preferably from about 1 to about 20 centipoise at 25° C., and an electrical volume resistivity equal to or greater than $1\times10^9$ Ω-cm, preferably greater than or equal to $5\times10^9$ Ω-cm, and more preferably greater than or equal to $5\times10^{13}$ Ω-cm. The liquid selected also preferably has a dielectric constant below 3.0. Moreover, the vapor pressure at 25° C. is preferably less than 10 Torr in embodiments.

Preferably, the non-polar liquid selected for use according to the present invention is a branched chain aliphatic hydrocarbon, although straight-chain hydrocarbons can also suitably be used. A non-polar liquid of the ISOPAR™ series (manufactured by the Exxon Corporation) may also be used for the liquid toners and developers of the present invention. These hydrocarbon liquids are considered narrow portions of isoparaffinic hydrocarbon fractions with extremely high levels of purity. For example, the boiling range of ISOPAR G™ is between about 157° C. and about 176° C.; ISOPAR H™ is between about 176° C. and about 191° C.; ISOPAR K™ is between about 177° C. and about 197° C.; ISOPAR L™ is between about 188° C. and about 206° C.; ISOPAR M™ is between about 207° C. and about 254° C.; and ISOPAR V™ is between about 254.4° C. and about 329.4° C. ISOPAR L™ has a mid-boiling point of approximately 194° C. ISOPAR M™ has an auto ignition temperature of 338° C. ISOPAR G™ has a flash point of 40° C. as determined by the tag closed cup method; ISOPAR H™ has a flash point of 53° C. as determined by the ASTM D-56 method; ISOPAR L™ has a flash point of 61° C. as determined by the ASTM D-56 method; and ISOPAR M™ has a flash point of 80° C. as determined by the ASTM D-56 method. In embodiments of the present invention, ISOPAR L™ is the preferred liquid vehicle for the liquid toner and developer compositions.

While the ISOPAR™ series liquids can be the preferred nonpolar liquids for use as the dispersant in the liquid toners and developers of the present invention, the essential characteristics of viscosity and resistivity may be satisfied with other suitable liquids. Specifically, the NORPAR™ series of liquids, which are substantially pure compositions of n-paraffins available from Exxon Corporation, the SOLTROL™ series of liquids available from the Phillips Petroleum Company, and the SHELLSOL™ series of liquids available from the Shell Oil Company can also be selected and used in embodiments of the present invention.

The amount of the liquid employed in the liquid toners and developers of the present invention is, for example, from about 85 to about 99.9 percent, and preferably from about 90 to about 99 percent by weight of the total toner or developer dispersion. However, any other effective amount of liquid may be selected, depending, for example, on the desired final use of the composition. The total solids content of the toner or developer, which include resin, colorant and other additives such as charge control additives, in embodiments is, for example, 0.1 to 15 percent by weight, preferably 0.3 to 10 percent, and more preferably, 0.5 to 10 percent by weight.

Various charge control agents are known in the art and can readily be used in the liquid toners and developers of the present invention. For example, particularly suitable charge control agents include the Pluronic series available from BASF, and particularly the PEO:PPO:PEO triblock copolymer charge control agent Pluronic F-108. Other charge control agents are disclosed, for example, in U.S. Pat. Nos. 5,866,292 and 5,688,624, the entire disclosures of which are incorporated herein by reference.

After the ingredients are introduced into the vessel, with suitable particulate grinding media contained therein, the contents are mixed and ground for a suitable period of time to provide the desired particle size of solid material dispersed in the liquid carrier. In embodiments, the mixing is conducted, for example, for from about 0.5 to about 8 hours. Preferably, mixing is conducted for from about 1 to about 6 hours, more preferably for from about 2 to about 5 hours, and most preferably about 4 hours. Of course, longer or shorter mixing times can be used depending, for example, upon the starting particle size of the solid material, the desired final particle size of the material, and the specific nature of the composition.

The cold grinding operation is preferably conducted at a temperature of from about 0 to about 50° C. When the grinding is to be conducted at temperatures below ambient (room) temperature, or when cooling is necessary to remove heat generated either by the mixing operation or by the mixer itself, such cooling can be achieved by any suitable means. For example, cooling can be achieved by circulating cold water or a cooling material through an external cooling jacket of the mixer, as is known to those skilled in the art.

In the mixing step, it is preferred that the particulate media be maintained in continuous or substantially continuous movement. Such movement creates shear and/or impact forces, causing a desired reduction in the particle size of the solid material. The solid material is ground so as to provide solid particles of the desired particle size. Preferably, the final average (by area) particle size of the solid material dispersed in the liquid carrier is less than 20 μm, and preferably less than 10 μm. More preferably, the average particle size of the solid material is from about 1 to about 10 μm, more preferably from about 2 to about 8 μm, and even more preferably from about 4 to about 6 μm.

Following the grinding operation, the solid particles, optionally with the liquid carrier, can be removed from the mixing apparatus and separated from the grinding media. If desired, particle size classification can be used to remove solid particles from the resultant dispersion that are larger and/or smaller than a desired size range.

If necessary, the concentration of the solid particles in the dispersion can be adjusted by addition or subtraction of liquid carrier. For example, the concentration can be reduced by the addition of additional amounts of the same or different non-polar liquid. The dilution can be conducted to reduce the concentration of solid particles in the liquid toner to between about 0.1 and about 5 percent by weight, preferably from about 0.5 to about 3 percent by weight, and more preferably from about 1 to about 2 percent by weight, with respect to the non-polar liquid.

A charge director is also preferably added to the dispersion to provide the final liquid toner or developer. Charge directors are preferably included in the liquid toner in any effective amount to initiate desired charging of the solid particles contained in the dispersion. In embodiments, the charge director is included in an amount of, for example, from about 0.001 to about 5 percent by weight, and preferably from about 0.005 to about 1 percent by weight, based on a total weight of solids contained in the liquid toner.

Suitable charge directors include any of the various charge directors known in the art for initiating the desired charging of the solid particles. General classes of charge directors include the aluminum salts of alkylated salicylic acid and the aluminum salts of alkylated salicylic acid. For example, suitable charge directors for use in the liquid toners of the present invention include, but are not limited to, aluminum di-tertiary-butyl salicylate (abbreviated Alohas); hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis [monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis [monoalkylated hydroxy naphthoic acid] aluminate; bis [dialkylated hydroxy naphthoic acid] aluminate wherein alkyl preferably contains 1 to about 6 carbon atoms; bis [trialkylated hydroxy naphthoic acid] aluminate wherein alkyl preferably contains 1 to about 6 carbon atoms; bis [tetraalkylated hydroxy naphthoic acid] aluminate wherein alkyl preferably contains 1 to about 6 carbon atoms; EMPHOS PS-900™, mixtures thereof and the like. Other suitable charge directors are disclosed in U.S. Pat. Nos. 5,563,015 and 5,672,456, the entire disclosures of which are incorporated herein by reference. In embodiments of the present invention, the charge director is preferably Alohas alone, or a mixture of Alohas with EMPHOS PS-900 ™.

In other embodiments of the present invention, the charge director can be an inverse micelle, used to facilitate particle charging. The charge director can be comprised of quaternary ammonium salts, which are often polymeric in nature, conductive metal oxides, metal and organometallic salt, and the like. Particularly preferred charge director compounds useful in the present invention are comprised of a protonated AB diblock copolymer selected from the group of poly[2-dimethylammonium ethyl methacrylate bromide co-2-ethylhexyl methacrylate], poly[2-dimethylammonium ethyl methacrylate tosylate co-2-ethylhexyl methacrylate], poly [2-dimethylammonium ethyl methacrylate chloride co-2-ethylhexyl methacrylate], poly[2-dimethylammonium ethyl methacrylate bromide co-2-ethylhexyl acrylate], poly[2-dimethylammonium ethyl acrylate bromide co-2-ethylhexyl methacrylate], poly[2-dimethylammonium ethyl acrylate bromide co-2-ethylhexyl acrylate], poly[2-dimethylammonium ethyl methacrylate tosylate co-2-ethylhexyl acrylate], poly[2-dimethylammonium ethyl acrylate tosylate co-2-ethylhexyl acrylate], poly[2-dimethylammonium ethyl methacrylate chloride co-2-ethylhexyl acrylate], and poly[2-dimethylammonium ethyl acrylate chloride co-2-ethylhexyl acrylate], poly[2-dimethylammonium ethyl methacrylate bromide co-N,N-dibutyl methacrylamide], poly[2-dimethylammonium ethyl methacrylate tosylate co-N,N-dibutyl methacrylamide], poly[2-dimethylammonium ethyl methacrylate bromide co-N,N-dibutylacrylamide], poly[2-dimethylammonium ethyl methacrylate tosylate co-N,N-dibutylacrylamide], and the like, and mixtures thereof.

As will be apparent to those of ordinary skill in the art, various other additives, known in the art, can be added to the liquid developer. Such additives can be used in their known amounts to provide known effects to the liquid developer.

As illustrated herein, the liquid inks, toners or developers of the present invention can be selected for imaging and printing methods wherein, for example, a latent image is formed on a photoconductive imaging member, such as disclosed in U.S. Pat. Nos. 4,265,990 and 5,414,498, the entire disclosures of which are incorporated herein by reference, followed by development with the liquid toner of the present invention by, for example, immersion of the imaging member in the liquid toner; transfer to a suitable substrate like paper; and fixing by heating.

Advantages of the present invention, in addition to the advantage of allowing production of polyester-based developers, include increased homogeneity of the mixing process, and increased efficiency of the mixing process. In particular, in embodiments of the present invention where the colorant is a flushed pigment, the present invention provides for increased homogeneity of the colorant/resin mixing process. Such increased homogeneity was not previously possible in attritor-based mixing operations, which typically used dry pigments.

Furthermore, the present invention provides increased efficiency in the mixing process, because the process can be more easily converted from mixing one color developer to mixing another color developer. In prior attritor mixing operations that used non-polyester resins, such as NUCREL or ELVAX, the polymer resin was melted in the attritor. As a result, melted resin tended to coat the attritor. Accordingly, conversion of the process from one color to another required that the attritors be thoroughly cleaned, which could be a difficult process. In contrast, because the polyester resins are not melted in the attritor in the present invention, there is not a problem of the resin coating the attritor. When it is desired to convert from one color to another, a simple cleaning operation can remove residual colroant and resin from the attirtor.

The following examples are illustrative of embodiments of the present invention, but are not limiting of the invention. It will be apparent, however, that the invention can be practiced with many different types and amounts of materials and can be used for a variety of different uses in accordance with the disclosure above and as pointed out hereinafter.

EXAMPLES

Examples 1–8

Liquid toners are made with varying amounts of charge director according to embodiments of the present invention.

First, a flushed pigment is prepared from the pigment Sunfast Blue 15:3 in SPAR II polyester resin. Additional SPAR II polyester resin is added to obtain a mixture having a pigment concentration of 25% by weight. This mixture is added to an extruder and melt-mixed to obtain a homogeneous dispersion of the pigment in the polyester resin. A Randcastle 0625 single screw extruder fitted with a "U.C. Mattock" screw is used to ensure greater mixing of the components, using the following parameters: the mixing temperature is from 220 to 251° F.; the melt (just before the material exits the die) and die temperature are about 240–243° F., screw rpm is 15 rpm, and the pressure during the extrusion ranges from 270 to 490 psi.

Following mixing, the extrudate is fine ground dry in a Fitz mill to obtain an average (by area) particle size of between 500 and 1000 $\mu$m.

The pre-ground resin/colorant dispersion is added to a Union Process 1S Attritor with a sufficient amount of ISOPAR™ L liquid carrier to provide a dispersion of the ground resin/colorant particles in the liquid. The mixture is cold mixed and ground in the Attritor for about four hours to obtain dispersed particles having an average (by area) particle size of about 4 to 5 $\mu$m dispersed in the ISOPAR™ L liquid carrier. The dispersion is separated from the Attritor grinding media.

Following separation, an ink (liquid toner) is made from the dispersion by adding a specified amount of one or more charge directors to initiate charging of the resin particles, and a further amount of ISOPAR™ L to obtain a final liquid toner having a solids content of about 2 percent by weight. In Examples 1–4, the charge director includes only Alohas; in Examples 5–8, the charge director is a 50:50 (by weight) mixture of Alohas and EMPHOS PS-900™. The specific type and amount of charge director(s) added to the composition is set forth in Table I, below. The amount is shown as total parts solids per parts charge director, each by weight.

To evaluate the development properties of the liquid toner compositions, electrophoretic mobility measurements are taken one day after addition of the charge directors. Electrophoretic mobility measurements are used because they provide an excellent indication of the functional development of the liquid toner in a print engine. The electrophoretic mobility measurements of the liquid toners are also presented in Table I below.

TABLE I

| Example | Charge Director | | Electrophoretic |
|---|---|---|---|
| # | Type | Amount | Mobility |
| 1 | Alohas | 5/1 | 26.9 |
| 2 | Alohas | 10/1 | 37.8 |
| 3 | Alohas | 15/1 | 53.0 |
| 4 | Alohas | 25/1 | 51.0 |
| 5 | Alohas/PS900 | 25/1 | 57.0 |
| 6 | Alohas/PS900 | 50/1 | 37.6 |
| 7 | Alohas/PS900 | 75/1 | 40.7 |
| 8 | Alohas/PS900 | 100/1 | 50.1 |

Examples 9–14

Liquid toners are made with varying amounts of charge director and charge control agent according to embodiments of the present invention.

The liquid toners are prepared following the same procedure as in Examples 1–8, with the addition of 1 part by weight charge control agent per 100 parts by weight total solids. The charge control agent used is Pluronic F-108. In these Examples, the charge control agent is added to the pre-ground colorant/resin mixture extrudate after removal from the Fitz mill in the form of a dispersion of fine ground charge control agent in an amount of ISOPAR™ L. The mixture of the charge control agent and pre-ground colorant/resin particles is then processed in the Attritor as described above.

In Examples 9–11, the charge director includes only Alohas; in Examples 12–14, the charge director is a 50:50 (by weight) mixture of Alohas and EMPHOS PS-900™. The specific type and amount of charge director(s) added to the composition is set forth in Table II, below. The amount is shown as total parts solids per parts charge director, each by weight.

As in Examples 1–8 above, the development properties of the liquid toner compositions are evaluated by means of electrophoretic mobility measurements. The electrophoretic mobility measurements of the liquid toners are also presented in Table II below.

TABLE II

| Example | Charge Director | | Electrophoretic |
|---|---|---|---|
| # | Type | Amount | Mobility |
| 9 | Alohas | 5/1 | 22.8 |
| 10 | Alohas | 10/1 | 31.7 |
| 11 | Alohas | 25/1 | 54.1 |
| 12 | Alohas/PS900 | 10/1 | 42.6 |
| 13 | Alohas/PS900 | 25/1 | 49.5 |
| 14 | Alohas/PS900 | 50/1 | 59.9 |

As will be apparent to one of ordinary skill in the art, numerous changes, alterations and adjustments can be made to the above-described embodiments without departing from the scope of the invention, and the invention is in no way limited to the specific exemplary embodiments described above. One skilled in the art will recognize that the various aspects of the invention discussed above may be selected and adjusted as necessary to achieve specific results for a particular application. Furthermore, although the above discussion has focused upon liquid toners, the invention is in no way limited to liquid toners, and in fact is applicable in other similar development agents. Thus, the foregoing embodiments are intended to illustrate and not limit the present invention. It will be apparent that various modifications can be made without departing from the spirit and scope of the invention.

What is claimed is:

1. A method for producing a liquid toner composition comprising:

melt-mixing a colorant and a thermoplastic resin in an extruder to homogeneously disperse the colorant in the thermoplastic resin to form a colorant/resin mixture;

mixing the colorant/resin mixture with a non-polar liquid to form a dispersion; and cold grinding the dispersion to form toner particles of the colorant/resin mixture dispersed in said non-polar liquid, wherein the particles have an average particle size of less than about 20 $\mu$m.

2. The method of claim 1, further comprising adding a charge control agent.

3. The method of claim 2, wherein said charge control agent is melt-mixed with said colorant and said thermoplastic resin.

4. The method of claim 2, wherein said charge control agent is added subsequent to said melt-mixing and is cold ground with the dispersion.

5. The method of claim 1, wherein said thermoplastic resin comprises a polyester resin.

6. The method of claim 1, wherein said thermoplastic resin comprises a non-polyester resin.

7. The method of claim 1, further comprising adding a charge director to said toner particles.

8. The method of claim 1, further comprising adding additional non-polar liquid to said dispersion of toner particles in said non-polar liquid to reduce a solids content of said dispersion.

9. The method of claim 8, wherein said solids content is reduced to between about 0.1 and about 15 percent by weight of the total dispersion.

10. The method of claim 1, wherein said colorant is a flushed colorant.

11. The method of claim 10, wherein said flushed colorant comprises pigment and resin.

12. The method of claim 11, wherein said resin is the same as said thermoplastic resin.

13. The method of claim 1, further comprising pre-grinding said colorant/resin mixture prior to mixing it with said non-polar liquid, to reduce a particle size of said colorant/resin mixture to between about 100 and about 2,000 $\mu$m.

14. The method of claim 1, wherein said non-polar liquid has a viscosity of from about 0.5 to about 500 cP at 25° C., an electrical volume resistance of greater than $1\times10^9$ Ω-cm, and a dielectric constant of less than about 3.0.

15. The method of claim 14, wherein said non-polar liquid has a viscosity of from about 1 to about 20 cP at 25° C. and an electrical volume resistance of greater than $5\times10^9$ Ω-cm.

16. The method of claim 1, wherein said non-polar liquid comprises a branched-chain aliphatic hydrocarbon.

17. The method of claim 1, wherein said cold grinding is conducted in an attritor.

18. A method for producing a polyester-based liquid toner composition comprising:

melt-mixing a flushed colorant and a polyester resin in an extruder to homogeneously disperse the flushed colorant in the polyester resin to form a colorant/resin mixture;

extruding said colorant/resin mixture with additional resin to achieve a lower pigment concentration;

dry grinding said extruded colorant/resin to an average particle size of between about 100 and about 2,000 $\mu$m;

mixing the dry ground colorant/resin mixture with a non-polar liquid to form a dispersion;

cold grinding the dispersion to form toner particles of the colorant/resin mixture dispersed in said non-polar liquid, wherein the particles have an average particle size of less than about 20 $\mu$m;

adding additional non-polar liquid to said dispersion of toner particles in said non-polar liquid to reduce a solids content of said dispersion to between about 0.1 and about 5 percent by weight of the total dispersion; and adding a charge director to said dispersion of toner particles.

19. A liquid toner made by the method of claim 1.

20. A liquid toner made by the method of claim 18.

* * * * *